US008261504B2

(12) United States Patent
Hakansson

(10) Patent No.: US 8,261,504 B2
(45) Date of Patent: Sep. 11, 2012

(54) V-GROOVE

(75) Inventor: Niclas Hakansson, Helsingborg (SE)

(73) Assignee: Valinge Innovation AB, Viken (SE)

( * ) Notice: Subject to any disclaimer, the term of this patent is extended or adjusted under 35 U.S.C. 154(b) by 0 days.

(21) Appl. No.: 11/822,709

(22) Filed: Jul. 9, 2007

(65) Prior Publication Data

US 2008/0000190 A1 Jan. 3, 2008

Related U.S. Application Data

(63) Continuation of application No. 11/643,881, filed on Dec. 22, 2006.

(60) Provisional application No. 60/757,893, filed on Jan. 11, 2006.

(51) Int. Cl.
*E04F 13/08* (2006.01)
*E04B 5/00* (2006.01)
*E04B 2/00* (2006.01)

(52) U.S. Cl. ..... 52/391; 52/506.01; 52/588.1

(58) Field of Classification Search ..... 52/311.2, 52/312, 313, 390–392, 455, 457, 458, 473, 52/506.01, 574, 578–588.1, 586.1–592.2
See application file for complete search history.

(56) References Cited

U.S. PATENT DOCUMENTS

| | | | |
|---|---|---|---|
| 1,568,605 | A | 1/1926 | Hough |
| 1,790,178 | A | 1/1931 | Sutherland |
| 2,082,186 | A | 6/1937 | Staude |
| 2,269,926 | A | 1/1942 | Crooks |
| 2,497,837 | A | 2/1950 | Nelson |
| 2,679,231 | A | 5/1954 | Pomper et al. |
| 2,791,983 | A | 5/1957 | Driskell |
| 2,811,133 | A | 10/1957 | Heino |
| 2,872,712 | A | 2/1959 | Brown et al. |
| 3,050,758 | A | 8/1962 | Wilkins |
| 3,339,525 | A | 9/1967 | Roberts |
| 3,341,351 | A | 9/1967 | Brewer |
| 3,354,867 | A | 11/1967 | Pomper |
| 3,440,790 | A | 4/1969 | Nerem |
| 3,508,523 | A | 4/1970 | De Meerleer |
| 3,627,608 | A | 12/1971 | Steiner et al. |
| 3,825,381 | A | 7/1974 | Dunning et al. |
| 3,932,258 | A | 1/1976 | Brinkman et al. |
| 3,998,181 | A | 12/1976 | Bellen et al. |
| 4,054,477 | A | 10/1977 | Curran |
| 4,076,880 | A | 2/1978 | Geschwender |
| 4,084,996 | A | 4/1978 | Wheeler |

(Continued)

FOREIGN PATENT DOCUMENTS

CH 690 242 A5 6/2000

(Continued)

OTHER PUBLICATIONS

International Search Report issued in PCT/SE2005/001491 (Published as WO 2007/081260 Al), Mar. 20, 2007, Swedish Patent Office, Stockholm, SE.
International Preliminary Report on Patentability issued in PCT/SE2006/001491 (Published as WO 2007/081260 A1), Apr. 29, 2008, IPEA/SE—Patent-och registreringsverket, Stockholm, SE.
Written Opinion issued in PCT/SE2006/001491 (Published as WO 2007/081260 A1), Mar. 20, 2007, ISA/SE—Patent-och registreringsverket, Stockholm, SE.

(Continued)

*Primary Examiner* — William Gilbert
*Assistant Examiner* — Elizabeth A Plummer
(74) *Attorney, Agent, or Firm* — Buchanan Ingersoll & Rooney

(57) ABSTRACT

The present invention relates to a floorboard and flooring with a decorative joint portion formed as U or V-shaped groove.

21 Claims, 7 Drawing Sheets

U.S. PATENT DOCUMENTS

| | | | | |
|---|---|---|---|---|
| 4,102,975 | A | 7/1978 | Doerer | |
| 4,147,448 | A | 4/1979 | Jeffery | |
| RE30,233 | E | 3/1980 | Lane et al. | |
| 4,290,248 | A | 9/1981 | Kemerer et al. | |
| 4,612,074 | A | 9/1986 | Smith | |
| 4,645,481 | A | 2/1987 | Klapp | |
| 4,716,700 | A | 1/1988 | Hagemeyer | |
| 4,751,957 | A | 6/1988 | Vaught | |
| 4,850,838 | A | 7/1989 | Wagner et al. | |
| 5,096,408 | A | 3/1992 | Bielfeldt | |
| 5,111,579 | A | 5/1992 | Andersen | |
| 5,190,088 | A | 3/1993 | Thomassen et al. | |
| 5,213,819 | A | 5/1993 | Bielfeldt | |
| 5,349,796 | A | 9/1994 | Meyerson | |
| 5,497,589 | A | 3/1996 | Porter | |
| 5,582,906 | A | 12/1996 | Romesburg et al. | |
| 5,587,218 | A * | 12/1996 | Betz | 428/67 |
| 5,641,553 | A | 6/1997 | Tingley | |
| 5,671,575 | A | 9/1997 | Wu | |
| 5,755,068 | A | 5/1998 | Ormiston | |
| 6,101,778 | A | 8/2000 | Martensson | |
| 6,115,926 | A | 9/2000 | Robell | |
| 6,126,883 | A | 10/2000 | Troetscher et al. | |
| 6,146,252 | A | 11/2000 | Martensson | |
| 6,180,211 | B1 | 1/2001 | Held | |
| 6,345,481 | B1 * | 2/2002 | Nelson | 52/592.2 |
| 6,374,880 | B2 | 4/2002 | Macpherson et al. | |
| 6,401,415 | B1 | 6/2002 | Garcia | |
| 6,532,709 | B2 | 3/2003 | Pervan | |
| 6,617,009 | B1 | 9/2003 | Chen et al. | |
| 6,679,011 | B2 | 1/2004 | Beck et al. | |
| 6,766,622 | B1 | 7/2004 | Thiers | |
| 6,769,218 | B2 | 8/2004 | Pervan | |
| 6,786,019 | B2 | 9/2004 | Thiers | |
| 7,047,697 | B1 * | 5/2006 | Heath | 52/177 |
| 7,101,438 | B2 | 9/2006 | Suzuki et al. | |
| 7,137,229 | B2 * | 11/2006 | Pervan | 52/313 |
| 7,584,583 | B2 | 9/2009 | Bergelin et al. | |
| 2002/0014047 | A1 | 2/2002 | Thiers | |
| 2002/0023702 | A1 | 2/2002 | Kettler | |
| 2002/0100231 | A1 | 8/2002 | Miller et al. | |
| 2002/0189183 | A1 * | 12/2002 | Ricciardelli | 52/390 |
| 2003/0041545 | A1 | 3/2003 | Stanchfield | |
| 2003/0101674 | A1 | 6/2003 | Pervan | |
| 2003/0159385 | A1 | 8/2003 | Thiers | |
| 2004/0031227 | A1 | 2/2004 | Knauseder | |
| 2004/0035077 | A1 | 2/2004 | Martensson | |
| 2004/0035078 | A1 | 2/2004 | Pervan | |
| 2004/0108625 | A1 | 6/2004 | Moder et al. | |
| 2004/0177584 | A1 | 9/2004 | Pervan | |
| 2004/0182036 | A1 | 9/2004 | Sjoberg et al. | |
| 2004/0255541 | A1 * | 12/2004 | Thiers et al. | 52/578 |
| 2005/0138881 | A1 | 6/2005 | Pervan | |
| 2005/0166514 | A1 * | 8/2005 | Pervan | 52/578 |
| 2005/0235593 | A1 | 10/2005 | Hecht | |
| 2006/0048474 | A1 | 3/2006 | Pervan et al. | |
| 2006/0073320 | A1 | 4/2006 | Pervan et al. | |
| 2006/0099386 | A1 | 5/2006 | Smith | |
| 2006/0110490 | A1 | 5/2006 | Nien | |
| 2006/0144004 | A1 | 7/2006 | Nollet et al. | |
| 2006/0179773 | A1 | 8/2006 | Pervan | |
| 2006/0260253 | A1 | 11/2006 | Brice | |
| 2007/0175143 | A1 | 8/2007 | Pervan et al. | |
| 2007/0175144 | A1 | 8/2007 | Hakansson | |
| 2007/0175148 | A1 | 8/2007 | Bergelin et al. | |
| 2007/0175156 | A1 | 8/2007 | Pervan et al. | |
| 2008/0000179 | A1 | 1/2008 | Pervan et al. | |
| 2008/0000183 | A1 | 1/2008 | Bergelin et al. | |
| 2008/0000417 | A1 | 1/2008 | Pervan et al. | |
| 2008/0005989 | A1 | 1/2008 | Pervan et al. | |
| 2008/0034701 | A1 | 2/2008 | Pervan | |
| 2008/0066425 | A1 | 3/2008 | Jacobsson et al. | |
| 2008/0120938 | A1 | 5/2008 | Jacobsson et al. | |
| 2008/0263975 | A1 | 10/2008 | Mead | |

FOREIGN PATENT DOCUMENTS

| | | | |
|---|---|---|---|
| CN | 2095236 | U | 2/1992 |
| CN | 1376230 | A | 10/2002 |
| DE | 199 07 939 | C1 | 5/2000 |
| DE | 100 08 166 | A1 | 9/2001 |
| DE | 100 34 407 | C1 | 10/2001 |
| DE | 100 57 901 | A1 | 6/2002 |
| DE | 202 06 460 | U1 | 8/2002 |
| DE | 102 32 508 | C1 | 12/2003 |
| DE | 10232508 | C1 * | 12/2003 |
| DE | 203 14 850 | U1 | 1/2004 |
| DE | 203 17 527 | U1 | 2/2004 |
| DE | 103 43 441 | B3 | 5/2005 |
| EP | 0 487 925 | A1 | 6/1992 |
| EP | 1 048 423 | A2 | 11/2000 |
| EP | 1 228 812 | A1 | 8/2002 |
| EP | 1 338 344 | A2 | 8/2003 |
| EP | 1 357 239 | A2 | 10/2003 |
| EP | 1 357 239 | A3 | 10/2003 |
| EP | 1 691 005 | A1 | 8/2006 |
| FR | 2 846 023 | A1 | 4/2004 |
| GB | 1 394 621 | A | 5/1975 |
| GB | 2 256 023 | A | 11/1992 |
| JP | 48-071434 | A | 9/1973 |
| JP | 49-031028 | B | 8/1974 |
| JP | 50-151232 | A | 12/1975 |
| JP | 55-099774 | U | 7/1980 |
| JP | 57-162668 | A | 10/1982 |
| JP | 57-185110 | A | 11/1982 |
| JP | 06-280376 | A | 10/1994 |
| JP | 8-033861 | A | 2/1996 |
| JP | 8-086080 | A | 4/1996 |
| JP | 09-088315 | A | 3/1997 |
| JP | 2000-079602 | A | 3/2000 |
| JP | 2000226932 | A * | 8/2000 |
| JP | 2001-179710 | A | 7/2001 |
| JP | 2001-260107 | A | 9/2001 |
| JP | 2001254503 | A * | 9/2001 |
| JP | 2002-276139 | A | 9/2002 |
| JP | 2002-371635 | A | 12/2002 |
| JP | 2003-126759 | A | 5/2003 |
| JP | 2003-200405 | A | 7/2003 |
| JP | 2004-027626 | A | 1/2004 |
| KR | 10 2007 0000322 | A | 1/2007 |
| SE | 525 661 | C2 | 3/2005 |
| SU | 1680359 | A1 | 9/1991 |
| WO | WO 94/26999 | A1 | 11/1994 |
| WO | WO 97/19232 | A1 | 5/1997 |
| WO | WO 97/47834 | A1 | 12/1997 |
| WO | WO 01/02103 | A2 | 1/2001 |
| WO | WO 01/96688 | A1 | 12/2001 |
| WO | WO 02/055809 | A1 | 7/2002 |
| WO | WO 02/055810 | A1 | 7/2002 |
| WO | WO 02/060691 | A1 | 8/2002 |
| WO | WO 03/012224 | A1 | 2/2003 |
| WO | WO 03/025307 | A1 | 3/2003 |
| WO | WO 03/078761 | A1 | 9/2003 |
| WO | WO 2004/053257 | A1 | 6/2004 |
| WO | WO 2005/054600 | A1 | 6/2005 |
| WO | WO 2005/068747 | A1 | 7/2005 |
| WO | WO 2006/031169 | A1 | 3/2006 |
| WO | WO 2006/038867 | A1 | 4/2006 |
| WO | WO 2006/043893 | A1 | 4/2006 |
| WO | WO 2006/088417 | A2 | 8/2006 |

OTHER PUBLICATIONS

Pervan, Darko, et al., U.S. Appl. No. 13/045,631, entitled "Floorboards with Decorative Grooves," filed in the U. S. Patent and Trademark Office on Mar. 11, 2011.

Bergelin, Marcus, et al., U.S. Appl. No. 13/046,011, entitled "Resilient Groove," filed in the U. S. Patent and Trademark Office on Mar. 11, 2011.

Bergelin, Marcus, et al., U.S. Appl. No. 13/552,357 entitled "Resilient Groove," filed in the U.S. Patent and Trademark Office on Jul. 18, 2012.

* cited by examiner

V-GROOVE

The present application is a continuation of U.S. Ser. No. 11/643,881, filed in the United States on Dec. 22, 2006, which claims the benefit of provisional application Ser. No. 60/757,893, filed on Jan. 11, 2006.

FIELD OF THE INVENTION

The present invention relates to a floorboard with a decorative joint portion comprising a U or V-shaped groove and a flooring with such floorboards.

BACKGROUND

In particular, yet not restrictive manner, the invention concerns a laminate floorboard comprising a mechanical locking system, formed at least at two opposite edges and a decorative joint portion comprising an U or V-shaped groove only at one of two opposite edges of the floorboard. The following description of prior-art technique, problems of known systems and objects and features of the invention will above all, as a non-restrictive example, be aimed as the field of the application. It should be emphasized that the invention can be applied to any floorboard and combined with all types of known locking system, where the floorboards are intended to be joined using a mechanical locking system connecting the panels in the horizontal and vertical directions on at least two adjacent edges.

A flooring is known with floorboards that is provided with a decorative joint portion, in the form of a bevel at both adjacent joined edges of the floorboards, for example as described in WO 03/078761. Another embodiment described in WO 03/078761 is a flooring comprising floorboards that is provided with a decorative joint portion, in the form of a lower flat portion only at one of two adjacent joined edges of the floorboards. A floorboard with a U or V-shaped groove is shown in DE 102 32 508 C1.

SUMMARY

An embodiment of the present invention relates to a floorboard and flooring with a decorative joint portion, in particular a laminate floorboard, which provides for new embodiments according to different aspects offering respective advantages. Flooring and floorboards with a decorative joint portion known up to now have several disadvantages. The bevelled joint edge and the joint edge with a lower flat portion, both have the disadvantage that they collect moisture and dust, which penetrates into the joint down to the moisture sensitive core. The dust creates a gap in the joint when the panels move, e.g. due to humidity changes. The floorboard with the decorative joint portion according to an embodiment of the invention results in a more resilient edge, which make it possible to provide a tighter joint, and prevent dust and moisture to enter into the joint.

According to a first aspect, an embodiment of the invention provides for a laminate floorboard comprising a front face a rear face, a surface layer of resin-impregnated sheets, a wood-based core and a decorative joint portion comprising a U or V-shaped groove. If the joint edge is provided with a cut under the groove, forming a clearance when the edge of the floorboard is joined to an adjacent edge of another adjacent floorboard, the edges become even more resilient and tighter. A deeper grove also makes the joint more resilient.

Laminate flooring usually consists of a core of a 6-9 mm fibreboard, a 0.2-0.8 mm thick upper decorative surface layer of laminate, preferably comprising sheet material impregnated with thermosetting resins and a 0.1-0.6 mm thick lower balancing layer of laminate, plastic, paper or like material. The surface layer provides appearance and durability to the floorboards, and preferably contains at least one layer imprinted with a pattern, for example a wood pattern printed on a paper layer. The core provides stability, and the balancing layer keeps the board plane when the relative humidity (RH) varies during the year. The floorboards are generally laid floating, i.e. without gluing, on an existing subfloor.

A first advantage consists in that there are no dust or moisture collecting lower parts at the edge closet to the joint. A second advantage is that the U or V-shaped groove makes a joint gap less visible. A third advantage is that the joint with the U or V-shaped groove looks like a traditional joint with bevels, but is cheaper to manufacture since only one of the two adjacent joined edges is worked. A fourth advantage is that the groove makes the edge resilient, due to the upwardly directed ribbon closest to the joint, which makes the joint tighter and prevents dust and moisture to enter into the joint.

Preferably, a mechanical locking system is formed at least at two opposite edges of the floorboard, which facilitates the joining of a similar floorboard. Mechanical locking system are for example known from WO 94/26999, and another locking system, comprising a flexible tongue, especially advantageous at the short sides of rectangular floor boards, is described in PCT/SE2005/001586, owner Välinge Innovation AB. Other shapes of floorboards are also possible. Other mechanical locking system are also known, and possible to use, which are joined by Angling-Angling, Angling-Snapping or Snapping-Snapping. Floorboards with a mechanical locking system are generally laid floating, i.e. without gluing, on an existing subfloor. Floorboards according to the invention are especially beneficial in flooring installed semi-floating, with floorboards with overlapping edges. A semi-floating floor, which allows movement between the floorboards, is described in WO 2005/068747.

Evidently, it is also possible to use a tongue and a groove joint, usually combined with gluing or nailing or other fastening means.

According to a preferred embodiment of the first aspect, only one of two opposite edges of the floorboard is provided with the groove. A rectangular floorboard is preferably provided with the groove at only one long edge. It is also possible to provide a groove on only one of the long and only one of the short edges. Other shapes of the floorboards are also possible, e.g. a floorboard with 3, 5, 6, 7 and 8 edges.

Preferably the wood based core is made of MDF or HDF or a particleboard and the groove extends down to the core, which optionally is coloured.

The groove is according to another embodiment treated with oil or varnish or filled with a filling material.

It is also possible to replace the resin-impregnated sheets with a wood veneer, preferably treated with oil or varnish.

According to a second aspect, an embodiment of the invention provides for a floorboard comprising a solid wood body, a front face a rear face, a decorative joint portion comprising a U or V-shaped groove.

Preferably, a mechanical locking system is formed at the edges. Evidently, it is also possible to use a tongue and a groove joint, usually combined with gluing or nailing or other fastening means.

Optionally the floorboard is treated with oil or varnish and/or the groove is filled with a filler.

According to a third aspect of the invention, the floorboard provided with the decorative joint portion comprising a U or V-shaped groove is further provided with an horizontally protruding part configured such that it overlaps an adjacent edge of an adjacent similar floorboard when the floorboard is joined to the similar adjacent floorboard. In the third aspect, the cut under the groove and above the connecting means is for some applications not necessary since the protruding part prevents dust and moisture to penetrate in to the joint. However, the joint still looks like a traditional joint with bevels, but is cheaper to manufacture.

According to a second object, an embodiment of the invention provides for a flooring comprising at least one of the floorboards above in the first object, joined to one or more similar floorboards. Preferably, the flooring is joined floating or semi-floating.

In particular, an objective of this invention is to provide a floorboard with a decorative joint portion that prevents dust and moisture to enter into the joint and which also is cheap and easy to manufacture.

All references to "a/an/the [element, device, component, means, step, etc]" are to be interpreted openly as referring to at least one instance of said element, device, component, means, step, etc., unless explicitly stated otherwise.

DETAILED DESCRIPTION OF PREFERRED EMBODIMENTS

As represented in FIGS. 3-6, the invention relates to a floorboard and a flooring, provided with a decorative joint portion comprising a U or V-shaped groove.

Figure 1A:
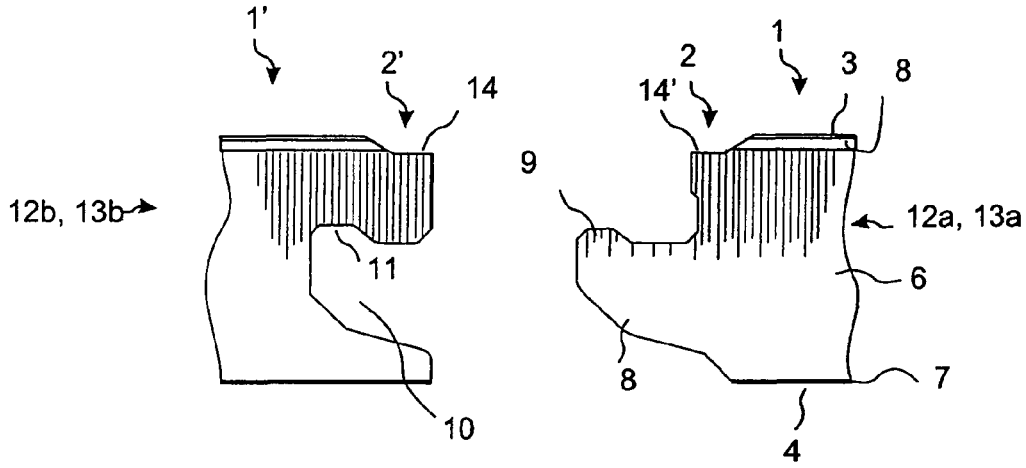
Prior Art Fig. 1a
FIGS. 1(*a*)-(*c*) and FIGS. 2(*a*)-(*b*) show floorboards with a decorative joint portion known in the art.

FIG. 1*a*-2*b* show floorboards with decorative joint portions known in the art. FIG. 1*a* shows a floorboard 1 according to WO 03/078761, to be joined with a similar floorboard 1' at a joint plane extending in the vertical plane, comprising a front face 3 and a rear face 4 extending in the horizontal plane, a surface layer 8, a core 6 and a balancing layer 7. Adjacent edges 12*a*, 13*a* and/or 12*b*, 13*b* (see FIG. 6) of the floorboards 1, 1' to be joined are provided with a decorative joint portion 2, 2', comprising a lowered horizontal surface 14. A mechanical locking system is formed along edges 12*a*, 13*a* and/or 12*b*, 13*b* of the floorboard, comprising a tongue 8 with a locking element 9, a tongue groove 10, and a locking groove 11.

Figure 1B:
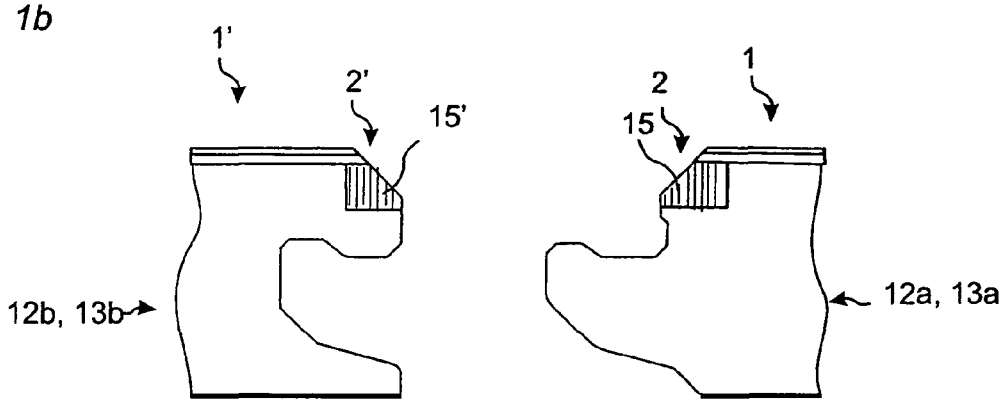

FIG. 1*b* shows another embodiment according to WO 03/078761, with decorative joint portions 2, 2' comprising a bevelled edge 15, 15' at both adjacent joint edges 12*b*, 13*b* and/or 12*a*, 13*a*.

Figure 1C:
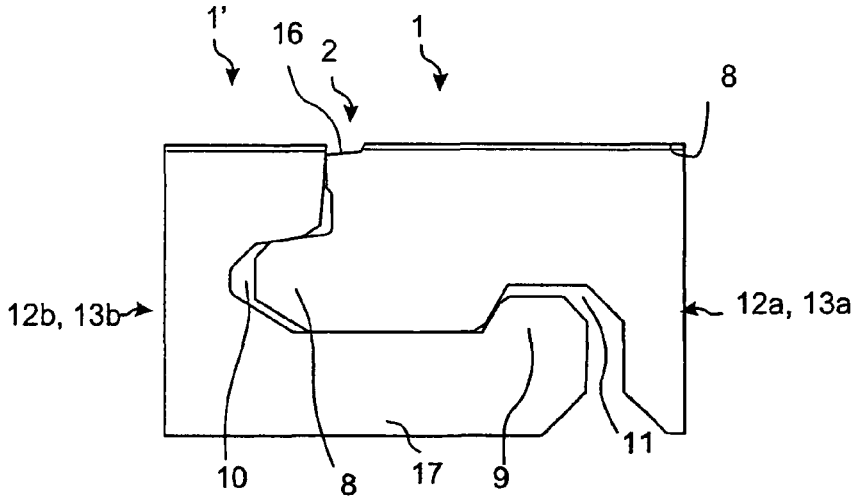

FIG. 1*c* shows another embodiment according to WO 03/078761, with a decorative joint portion 2, comprising a lowered horizontal surface 16 at one of the adjacent joint edges 12*b*, 13*b* and/or 12*a*, 13*a* of the floorboards to be joined. In this embodiment, the mechanical locking system comprising a locking strip 17 with a locking element 9, a tongue 8 and a tongue groove 10.

Figure 2A:
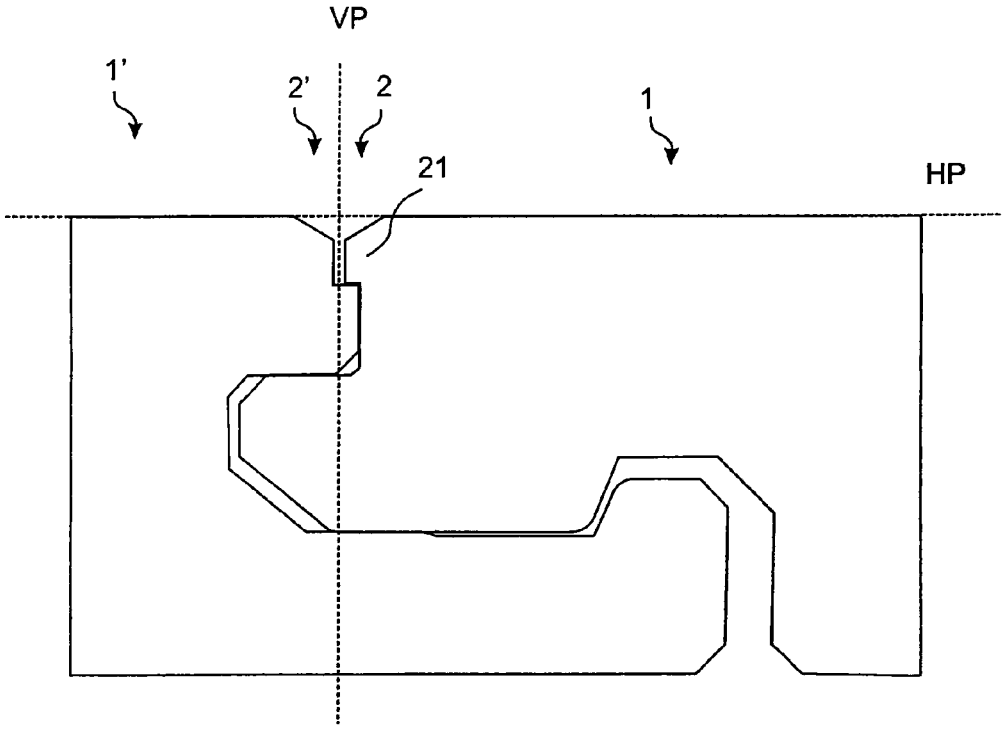
Prior Art Fig. 2a

FIG. 2*a* shows a floorboard 1 intended to be joined semi-floating with an adjacent floorboard 1 according to WO 2005/068747, with a horizontally protruding and overlapping part 21 at the joint edge and a decorative joint portion 2, 2', comprising a bevel, at both adjacent joint edges intended to be joined.

Figure 2B:
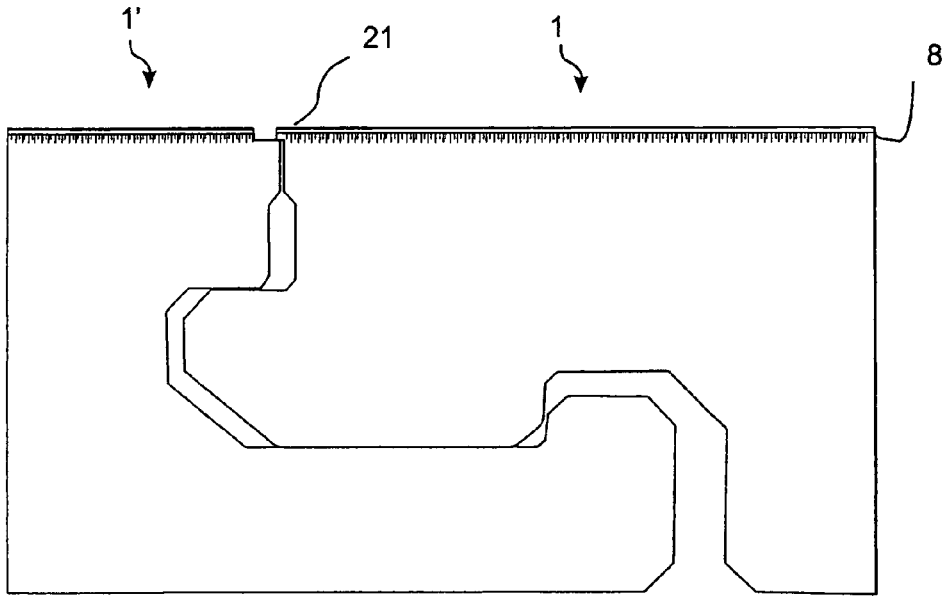

FIG. 2*b* shows another embodiment according to WO 2005/068747, intended to be joined semi-floating, with a decorative joint portion, comprising a lowered horizontal surface, at one of the adjacent joint edges 12*b*, 13*b* and/or 12*a*, 13*a* of the floorboards to be joined. The horizontally protruding and overlapping part 21 is thin and consists of the high strength layers of the resin-impregnated sheets of the surface layer and optionally a part of the core, which preferably also is impregnated with resin.

Figure 3A:
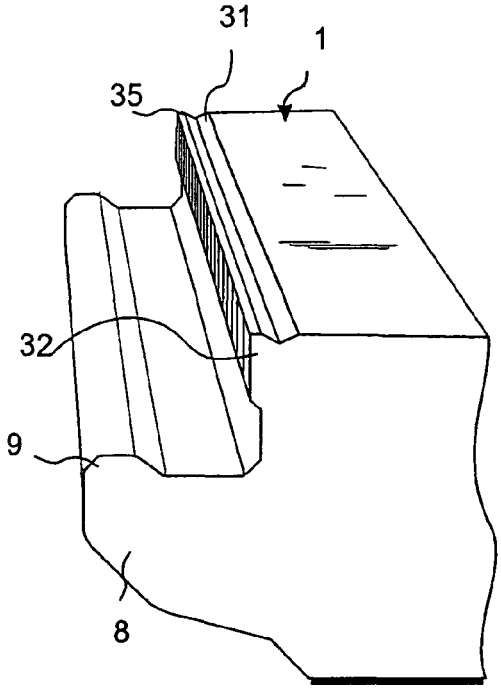
FIGS. 3*a-b* show embodiments of a floorboard according to the invention comprising a decorative joint portion.
Figure 3B:
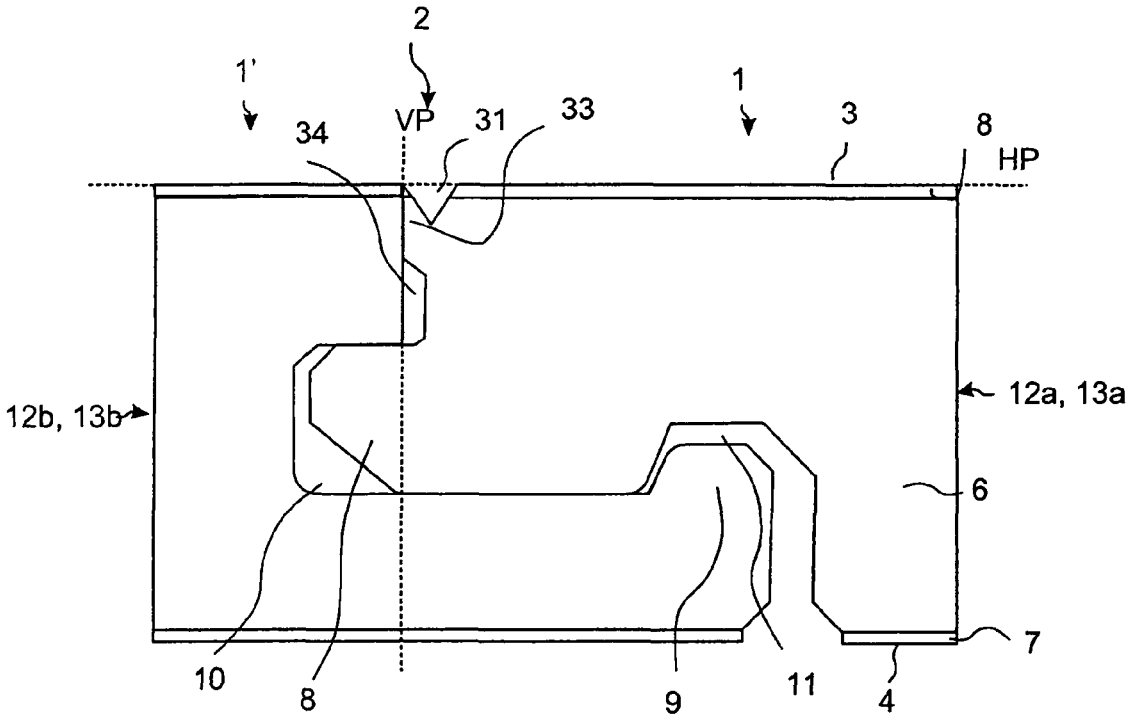

According to a first embodiment of the invention, represented in FIG. 3*a-b*, a laminate floorboard 1, to be joined with a similar floorboard 1' at adjacent joint edges at a joint plane extending in the vertical plane VP, comprising a front face 3 and a rear face 4 extending in the horizontal plane HP, a surface layer 8, a wood-based core 6 and preferably a balancing layer 7. The joint edge 12*a*, 13*a* or 12*b*, 13*b* (see FIG. 6) of the floorboard 1 to be joined are provided with a decorative joint portion 2, comprising a U or V-shaped groove 31. Preferably the U or V-shaped groove is provided only at one of two opposite edges of the floorboard. If the floorboard is rectangular, preferably only one of the long edges is provided with the U or V-shaped groove, certainly it is also possible provide one of the long and one of the short edges with the groove 31. Other shapes of the board are also possible, e.g. 3, 5, 6, 7 and 8 edges.

Preferably a mechanical locking system is formed along the joint edges 12*a*, 13*a* and/or 12*b*, 13*b* of the floorboard. One embodiment of the locking system is represented in FIG. 3*a*, and comprising a tongue 8 with a locking element 9 at one of the adjacent joint edges to be joined, and a tongue groove and a locking groove, not shown, at the other edge, alike as shown in FIGS. 1*a*-1*b*. Another embodiment of the locking system is represented in FIG. 3*b*, and comprising a tongue 8 and the locking groove at one of the adjacent joint edges to be joined, and a tongue groove and a locking element, at the other edge. Other known locking systems are also possible to use.

Figure 4A:
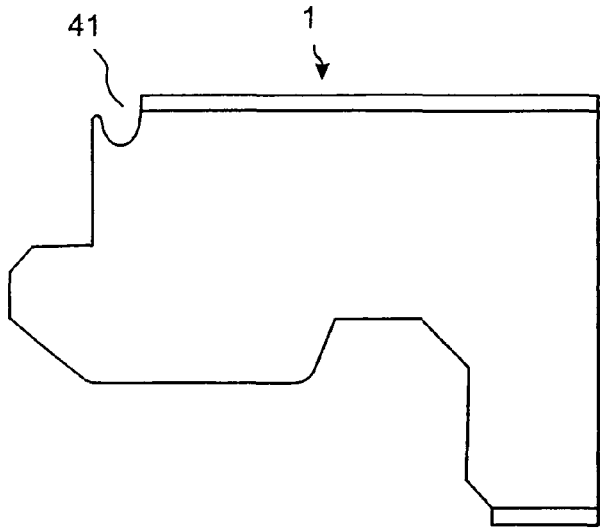
FIGS. 4*a-c* show embodiments of a floorboard according to the invention comprising a decorative joint portion.
Figure 4B:
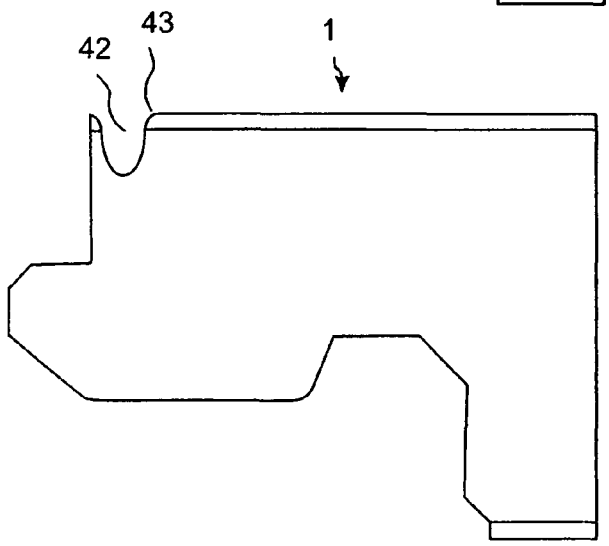

The joint edge is provided with a cut 34, which in combination with groove 31, makes the edge more resilient and tighter. A deeper grove also makes the joint more resilient. In FIG. 3*a* the groove creates a ribbon 32 along the joint edge, which in this embodiment has a flat upper tip 35. In FIG. 3*b* the ribbon 33 has a sharp upper tip, comprising the surface layer. Other shapes of the ribbon are shown in FIG. 4*a-b*, comprising rounded edges 43 and different height levels of the tip 44 and with or without the surface layer. All the features of the shown shapes are possible to combine. The grooves 41, 42 shown in FIGS. 4*a-b* are U-shaped, but is possible to replace with a V-shape or vice verse in FIGS. 3, 5, 6 and 7.

The wood-based core is preferably a particle, MDF or HDF board.

Figure 4C:
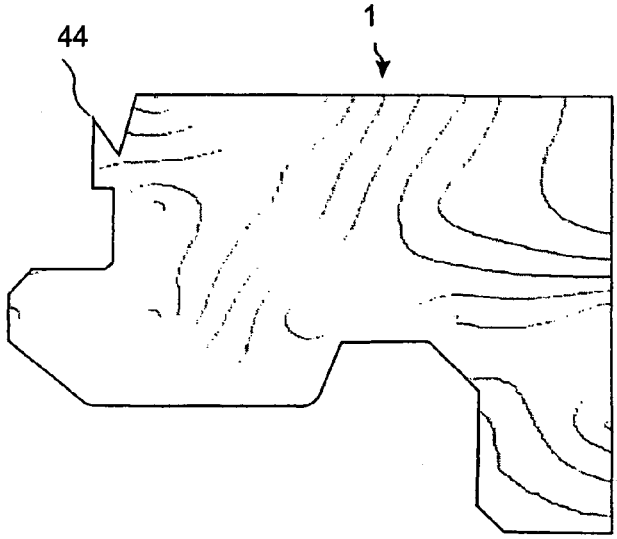

A second embodiment of the invention, represented in FIG. 4*c*, comprises floorboard with a body of solid wood, and a U or V-shaped groove along a joint edge of the floorboard. The mechanical locking system, the cut 34 and shapes of ribbon 32, 33 and groove described in connection with the first embodiment is applicable also to the second embodiment. Preferably the front face of the floorboard is treated with oil or varnish.

Figure 5:
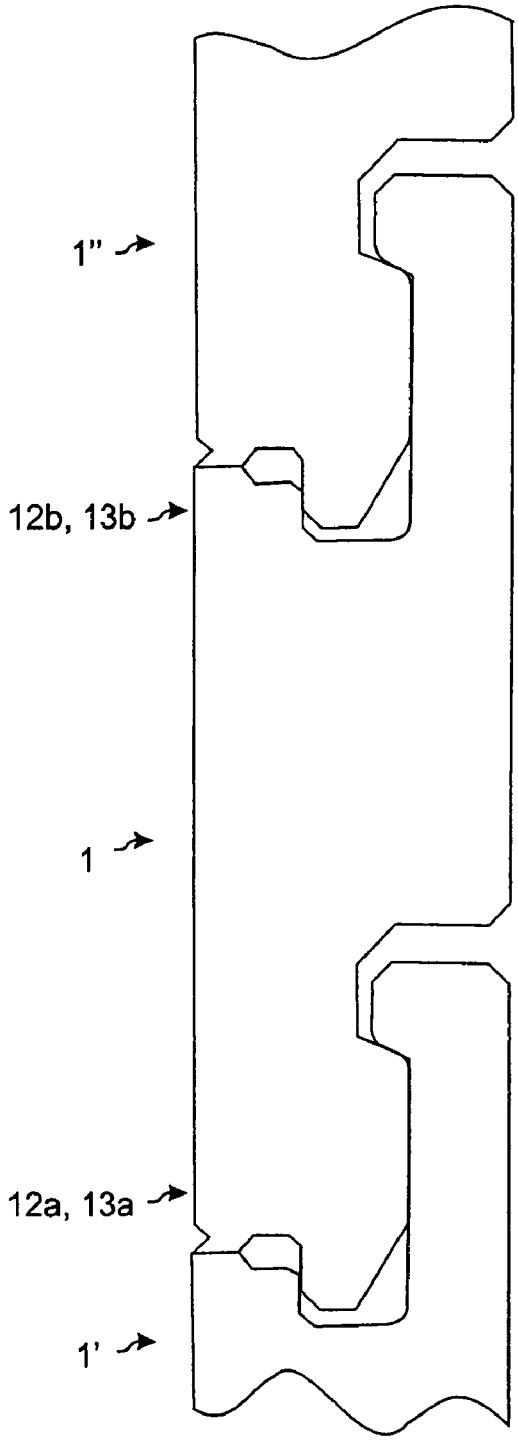
FIG. 5 shows an embodiment of the floorboards mechanically joined to a flooring.

In FIG. 5 a floorboard 1 according to the first or second embodiment, joined at two opposite edges 12*a*, 13*a* and 12*b*, 13*b*, is shown. The edges of the floorboard are joined with a mechanical locking system to adjacent floorboards 1', 1". The floorboard is provided with the decorative U or V-shaped groove only at one of the two opposite edges of the floorboard.

Figure 6A:
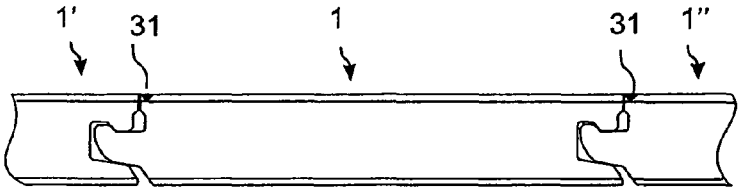
FIGS. 6*a-c* show a floorboard and a flooring according to one embodiment of the invention.
Figure 6B:
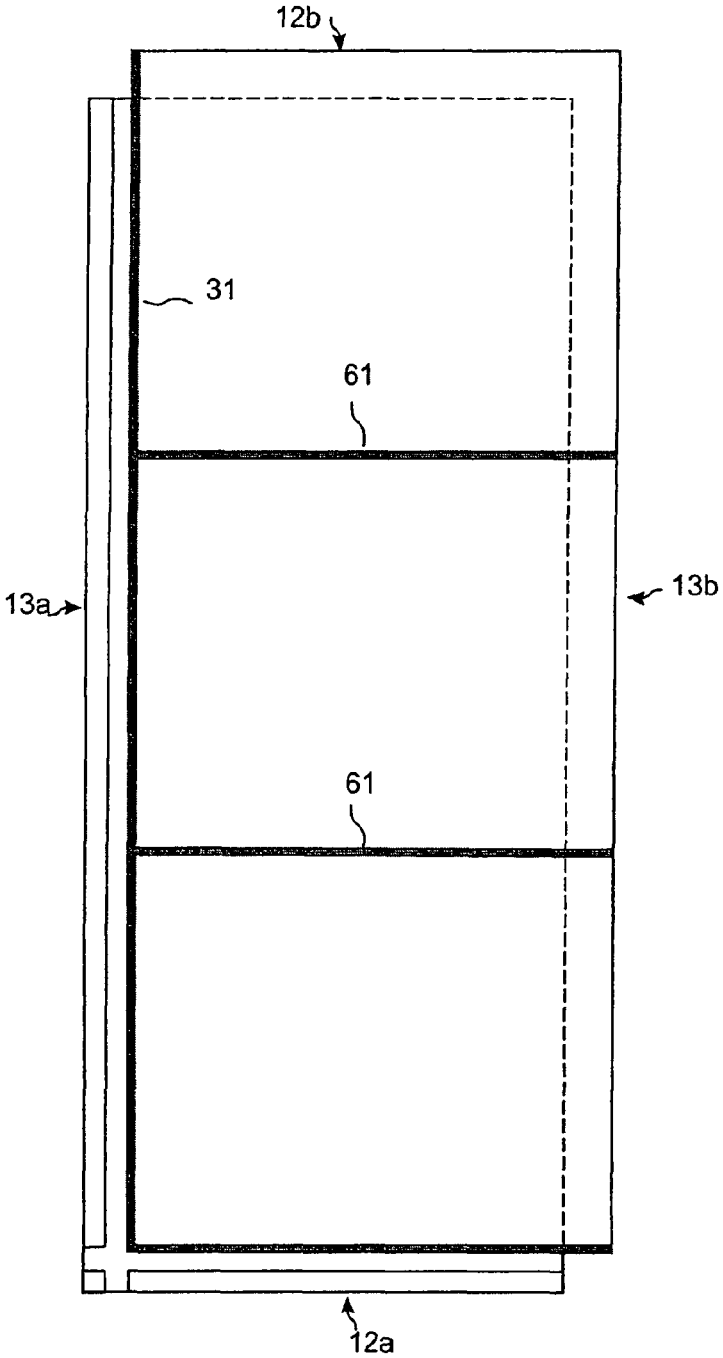
Figure 6C:
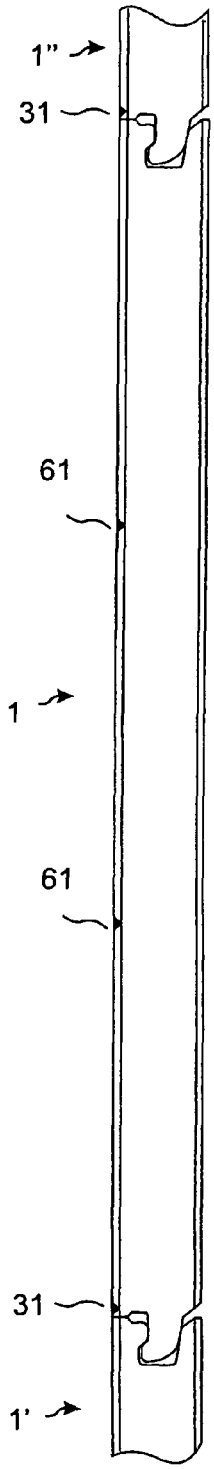

In FIG. 6*b* an embodiment is shown according to the first embodiment, comprising a rectangular floorboard 1 with a mechanical locking system at long edges 13*a*, 13*b* and short edges 12*a*, 12*b* and a U or V-shaped groove 31 along only one of the long edges and along only one of the short edges, which are filled with a filler. Additional V-shaped grooves 61 between the short edges are provided. FIG. 6*a* is a cross section of the floorboard in FIG. 6*b*, perpendicular to the long edges, joined to similar floorboards 1' and 1". FIG. 6*c* is a cross section of the floorboard in FIG. 6*b*, perpendicular to the short edges, joined to similar floorboards 1' and 1". Certainly it is possible to fill the grooves 31 with a filler also at a floorboard according to the second embodiment and provide it with the additional grooves 61.

Figure 7A:
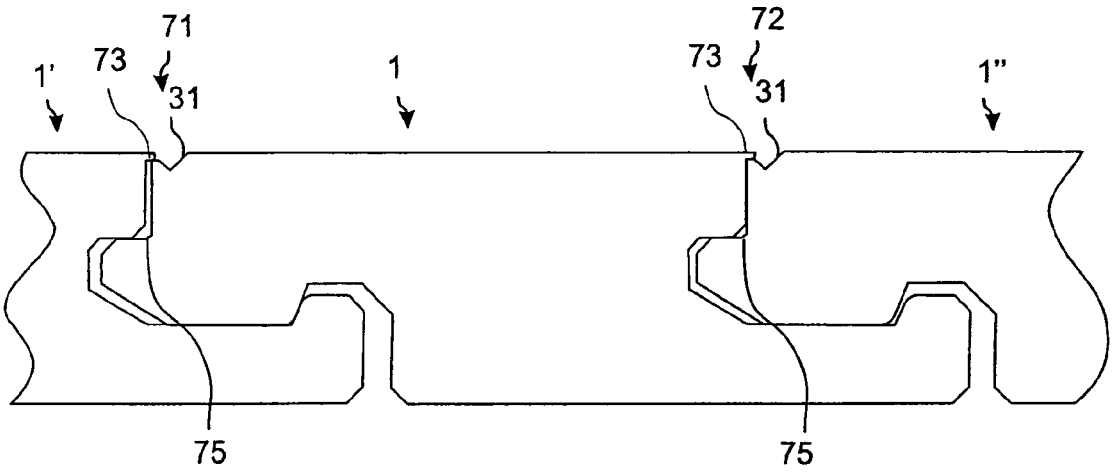
FIGS. 7*a-b* show a floorboard and a flooring according to one embodiment of the third aspect of the invention.
Figure 7B:
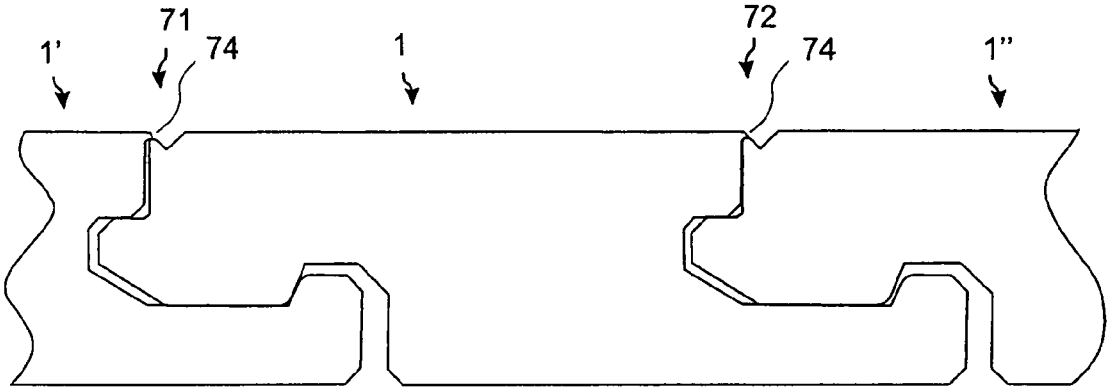

According to a third embodiment of the invention, represented in FIG. 7*a-b*, a floorboard 1, 1', 1" is provided with a decorative joint portion comprising a U or V-shaped groove 31 at an edge and a horizontally protruding part 73 at another opposite edge. The protruding part is configured such that it overlaps an adjacent edge, with a decorative joint portion, of an adjacent similar floorboard when the floorboard is joined to the similar adjacent floorboard. The protruding part prevents dust and moisture to penetrate in to the joint.

An object of the invention is a flooring comprising at least two of the floorboards above, according to the first or second embodiment, preferably joined as floating or semi-floating floor.

A semi-floating embodiment is shown in FIG. 7*a-b*. One of the floorboard 1 is joined along two opposite edges with a mechanical locking system to similar floorboards 1', 1". The floorboard is provided with the U or V-shaped groove at only one of the opposite edges. An outer relative joint position 71 and an inner relative joint position 72 are shown. In the outer relative joint position 71 the distance between the adjacent and joined floorboards 1', 1 is the largest possible and in the inner relative position 72, the distance between the adjacent and joined floorboards 1, 1" is the smallest possible. The joints are provided with overlapping and horizontally extending edges, which in both the inner and outer relative positions cover the joint gaps. FIG. 7*b* shows an embodiment of the overlapping edge comprising a bevelled edge 74.

The invention has mainly been described above with reference to a few embodiments. However, as is readily appreciated by a person skilled in the art, other embodiments than the ones disclosed above are equally possible within the scope of the invention, as defined by the appended patent claims.

Generally, all terms used in the claims are to be interpreted according to their ordinary meaning in the technical field, unless explicitly defined otherwise herein.

The invention claimed is:

1. A set of essentially identical floorboards, each floorboard comprising:

a front face and a rear face, a decorative joint portion at an edge and at the front face of the floorboard, and connectors arranged on at least two opposite edges for connecting the floorboard with a similar floorboard in a vertical direction, a horizontal direction, or both vertical and horizontal directions, wherein the decorative joint portion of an edge of a floorboard comprises an U or V-shaped groove and is configured to be joined with an adjacent edge of another floorboard, wherein the edge with the decorative joint portion is provided with a flat horizontal surface between the U or V-shaped groove and the outer edge of the floorboard and wherein the adjacent edge comprises a horizontally protruding part configured to overlap the edge of the floorboard with the decorative joint portion comprising the U or V-shaped groove and to cooperate with the flat horizontal surface and wherein the horizontally protruding part does not extend over the U or V-shaped groove.

2. The set of essentially identical floorboards as claimed in claim 1, wherein each floorboard is provided with the decorative joint portion only at one of two opposite edges.

3. The set of essentially identical floorboards as claimed in claim 2, wherein each floorboard is quadrilateral and has a decorative joint portion only at one edge.

4. The set of essentially identical floorboards as claimed in claim 2, wherein each floorboard is quadrilateral and has a decorative joint portion only at two adjacent edges.

5. The set of essentially identical floorboards as claimed in claim 1, wherein each floorboard is a laminate floorboard comprising a core of a wood-based material and a surface layer.

6. The set of essentially identical floorboards as claimed in claim 5, wherein the core comprises HDF, MDF or particleboard.

7. The set of essentially identical floorboards as claimed in claim 5, wherein each floorboard comprises a surface layer of wood veneer.

8. The set of essentially identical floorboards as claimed in claim 5, wherein each floorboard comprises a surface layer of resin impregnated sheets.

9. The set of essentially identical floorboards as claimed in claim 5, wherein the groove intersects the surface layer and extends into the core.

10. The set of essentially identical floorboards as claimed in claim 5, wherein the groove is formed solely in the surface layer.

11. The set of essentially identical floorboards as claimed in claim 1, wherein each floorboard is substantially of solid wood.

12. The set of essentially identical floorboards as claimed in claim 1, wherein the connector is a mechanical locking system.

13. The set of essentially identical floorboards as claimed in claim 1, wherein the groove is treated with oil or varnish.

14. The set of essentially identical floorboards as claimed in claim 1, wherein the groove is filled with a filler.

15. The set of essentially identical floorboards as claimed in claim 1, wherein the groove is formed in the edge of the floorboard above the connector.

16. Flooring comprising the set of essentially identical floorboards in accordance with claim 1, wherein only one edge of two joined and adjacent floorboard edges comprises the U- or V-shaped groove.

17. The flooring as claimed in claim 16, wherein the set of essentially identical floorboards are mechanically joined at adjacent edges.

18. The flooring as claimed in claim 17, wherein the flooring is a semi-floating floor.

19. The set of essentially identical floorboards as claimed in claim 1, wherein the flat horizontal surface is below the plane of the surface of each floorboard.

20. The set of essentially identical floorboards as claimed in claim 1, wherein the U or V-shaped groove has one long side and one short side and wherein the flat horizontal surface coincides with the short side of the U or V-shaped groove.

21. The set of essentially identical floorboards as claimed in claim 1, wherein the edge with the decorative joint portion is provided with a cut under the U or V-shape groove and above the connector, that the U or V-shaped groove, the cut and the connectors are configured to obtain a resilient edge and a tight joint, and in that the connectors is a mechanical locking system comprising a locking element and a locking groove horizontally displaced away from the U or V-shaped groove to obtain a resilient and tight joint.

* * * * *